US010205284B1

(12) United States Patent
Wang et al.

(10) Patent No.: US 10,205,284 B1
(45) Date of Patent: Feb. 12, 2019

(54) HIGH-LOW FREQUENCY MIXED CONNECTOR

(71) Applicant: Dongguan Taisol Electronics Co., Ltd., Dongguan (CN)

(72) Inventors: Jinyan Wang, Dongguan (CN); Chaotao Zhang, Dongguan (CN)

(73) Assignee: DONGGUAN TAISOL ELECTRONICS CO., LTD., Dongguan (CN)

( * ) Notice: Subject to any disclaimer, the term of this patent is extended or adjusted under 35 U.S.C. 154(b) by 0 days.

(21) Appl. No.: 15/825,108

(22) Filed: Nov. 29, 2017

(51) Int. Cl.
*H01R 13/646* (2011.01)
*H01R 13/50* (2006.01)
*H01R 13/24* (2006.01)

(52) U.S. Cl.
CPC ..... *H01R 13/646* (2013.01); *H01R 13/2471* (2013.01); *H01R 13/50* (2013.01)

(58) Field of Classification Search
CPC .. H01R 13/646; H01R 13/2471; H01R 13/50; H01R 12/722; H01R 12/7073; H01R 24/50
USPC ..... 439/345, 541.5, 540.1, 607.11, 607.32, 439/607.4, 607.35, 620.06
See application file for complete search history.

(56) References Cited

U.S. PATENT DOCUMENTS

| | | | | |
|---|---|---|---|---|
| 6,832,929 | B2 * | 12/2004 | Garrett | G11B 33/122 439/378 |
| 8,142,225 | B2 * | 3/2012 | Yu | H01R 12/725 439/607.35 |
| 8,851,927 | B2 * | 10/2014 | Hsu | H01R 12/724 439/607.11 |
| 8,951,053 | B2 * | 2/2015 | Ho | H01R 27/00 439/159 |
| 9,147,979 | B1 * | 9/2015 | Chung | H01R 12/727 |
| 2004/0092143 | A1 * | 5/2004 | Fromm | H01R 13/6471 439/108 |
| 2005/0059296 | A1 * | 3/2005 | Wang | H01R 13/6477 439/541.5 |
| 2014/0004744 | A1 * | 1/2014 | Hsu | H01R 13/658 439/626 |

* cited by examiner

*Primary Examiner* — Harshad C Patel
(74) *Attorney, Agent, or Firm* — Wayne & Ken, LLC; Tony Hom

(57) ABSTRACT

The present invention relates to a high-low frequency mixed connector, includes an insulator and high frequency pins and low frequency pins set on the insulator, the low frequency pins includes large current pins and small current pins; wherein, the high frequency pins are installed on the insulator by means of shrapnel or hot bar welding, the low frequency pins are installed on the insulator by means of crimping, and the high frequency pins and the low frequency pins are arranged in different directions. The high-low frequency mixed connector in the present invention contains the high frequency pins and the low frequency pins in the terminal, and the high frequency pins and the low frequency pins are arranged in different directions, thus, it is convenient for users to use high frequency and high current connectors with low cost and high efficiency.

10 Claims, 4 Drawing Sheets

HIGH-LOW FREQUENCY MIXED CONNECTOR

FIELD OF THE INVENTION

The invention relates to the technology field of decanters, more particularly relates to a decanter assembly.

BACKGROUND OF THE INVENTION

With the development of the electronic industry, all kinds of electronic products are constantly innovated. Especially personal computers, tablet PCs and smart phones, etc. are widely used in the life of the general public at a very high speed because of their convenience and powerful.

In recent years, with the popularity of the Universal Serial Bus (USB) connectors, almost all kinds of electronic devices are equipped with USB connectors. With USB connectors, User of electronic devices can easily transfer data. At present, the most widely used USB connectors are USB2.0 specification that can supports high speed transmission (Hi-Speed, 480 Mbps) and USB3.0 specification that can supports super high speed transmission (Super-Spee, 5 Gpbs). However, with the improvement of the digital data quality (for example undistorted audio signal and high resolution image signal), the capacity of digital archives is surged, traditional USB2.0 connectors and USB3.0 connectors offer the speed of transmission that has gradually been unable to meet the needs of existing users. As for this, USB3.1 specification are introduced on the market, among which, the Type-C connectors are the most impressive. Concretely, USB Type-C connector not only overcomes the problem that traditional USB connector can not simultaneously plug in and anti-plug in with the structure of 24 terminals on top and bottom, but also provides data transmission speed up to 10 Gbps.

At present, among of the commonly used USB Type-C connectors in the market, most of the low frequency and the high frequency are used alone. Sometimes, to improve the efficiency of data transmission, it is necessary to assemble high frequency pin and low frequency pin on the shell of the same connector. CN201220648930.4 discloses high-low frequency mixed connector and its assembly, the front end of the high-low frequency mixed connector is inserted end, including metal connector housings, high frequency accessories and low-frequency accessories fixed on the rear side of the connector housing. The High frequency accessories include high frequency housings, the low frequency accessories include low frequency housings, both of the high frequency housings and the low frequency housings are metal housing. The font ends of the high frequency housings and the low high frequency housings are separately fixed on the connector housings by flange, and at least one of the front end faces of the high frequency housings and the low frequency housings has an annular shielding groove around its inner hole, a shielding ring corresponding to the shielding groove is arranged on the connector housings, and the shielding ring protrudes from the connector housing to the shielding groove corresponding to it. The utility model has the advantages that the high-low frequencies mixed connectors resolves the high and low frequency signals from interfering with each other at the condition that the high-low accessories can be replaced. However, in the patent, the high frequency and the low frequency are arranged side by side in parallel, causing that the user can not distinguish between high and low frequency, and it is not convenient to use.

Therefore, it is necessary to develop a mixed connector, which enables the user to distinguish between high and low frequency, thus the users can use high-low frequency mixed connector with low cost and high efficiency.

SUMMARY OF THE INVENTION

To overcome the above shortcomings, the present invention provides a kind of high-low frequency mixed connector, the high frequency and low frequency are installed in the different way, so that users can distinguish between the high frequency and the low frequency. It is easy to use and it has simple structure.

The technical proposal in the present invention are as followings: a kind of high-low frequency mixed connector, includes an insulator and high frequency pins and low frequency pins set on the insulator, the low frequency pins includes large current pins and small current pins; the high frequency pins are installed on the insulator by means of shrapnel or hot bar welding, the low frequency pins are installed on the insulator by means of crimping, and the high frequency pins and the low frequency pins are arranged in different directions.

The kind of high-low frequency mixed connector also includes metal shell, the metal shell covers the insulator, the insulator is provided with a first terminal group, a second terminal group and a third terminal group; pins of the first terminal group, pins of the second terminal group and pins of the third terminal group lead out from both sides and back of the metal shell; among the terminal groups, at least one group contains both the high frequency pins and the low frequency pins, and which are set perpendicular to each other.

The first terminal group, the second terminal group and the third terminal group are SMT type terminals, DIP type terminals, or DIP and SMT type terminals.

All of the first terminal group, the second terminal group and the third terminal group are SMT type terminals.

All of the first terminal group, the second terminal group and the third terminal group are DIP type terminals.

The first terminal group and the second terminal group are SMT type terminals, which are lead out both sides of the metal shell from the insulator, the third terminal group are DIP type terminals, which is lead out back of the metal shell from the insulator.

The first terminal group and the second terminal group are DIP type terminals, which are lead out both sides of the metal shell from the insulator, the third terminal group are SMT type terminals, which is lead out back of the metal shell from the insulator.

The pins are installed on the PCB board in the manner of SMT, DIP or DIP and SMT.

The riveting face of the metal shell is upwards, the riveting face rivets a shielding shell; the metal shell is provided with an iron tray, the iron tray is provided with an insulator, the first terminal group and the second terminal group leads out from both sides or back of the insulator, the third terminal group leads out from back or both sides of the insulator.

The kind of high-low frequency mixed connector includes a number of terminal groups arranged on both sides of the insulator; the terminal groups contains the high frequency pins and the low frequency pins, and which are set perpendicular to each other.

The advantages of the invention are as follows: The high-low frequency mixed connector, the high frequency pins are installed on the insulator by means of shrapnel or hot bar welding, the low frequency pins are installed on the insulator by means of crimping, and the high frequency pins and the low frequency pins are arranged in different directions, thus, it is convenient for users to distinguish the high frequency pin and the low frequency pin, and it is easy to use.

EMBODIMENTS

In order to make the purpose of the invention, the technical scheme and technical effect are more clear, the followings will further descript the present invention with the embodiments. It should be understand that the embodiments described herein are only used to interpret the present invention and are not intended to limit the invention.

Figure 1:
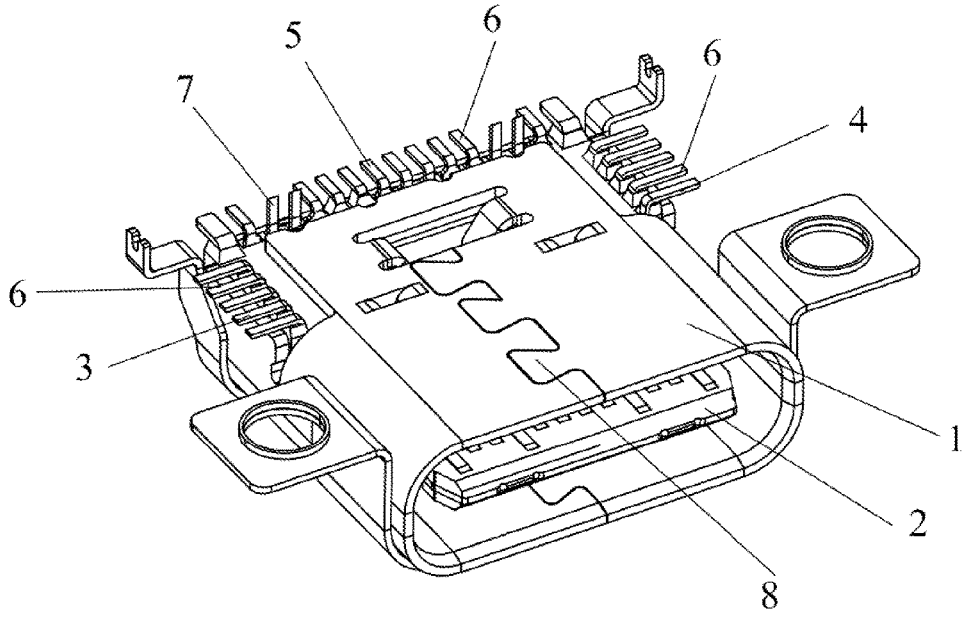
FIG. 1 shows the schematic structure of the high-low frequency mixed connector in present invention.
Figure 4:
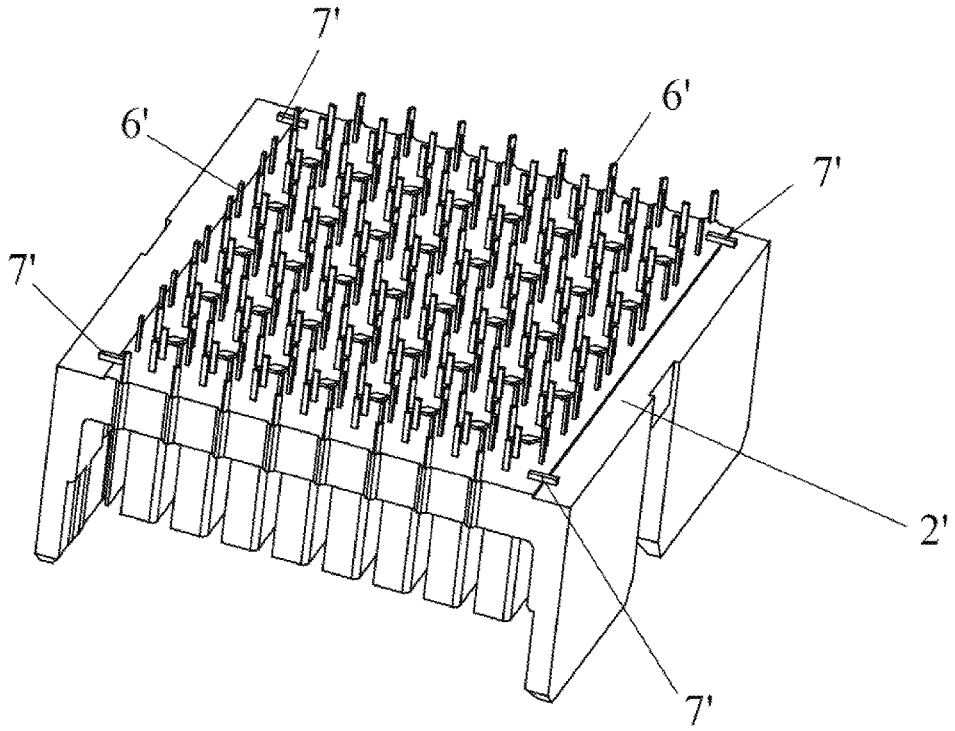
FIG. 4 shows the fourth schematic structure of the high-low frequency mixed connector in present invention.

Refer to FIG. 1 and FIG. 4, a kind of high-low frequency mixed connector, includes an insulator 2 (2'), and the low frequency pins 6 (6') and the high frequency pins 7 (7') set on the insulator 2 (2'), the low frequency pins 6(6') includes large current pins and small current pins. The high frequency pins 7 (7') are installed on the insulator 2 (2') by means of shrapnel or hot bar welding, the low frequency pins are installed on the insulator 2 (2') by means of crimping, and the high frequency pins 7 (7') and the low frequency pins 6 (6') are arranged in different directions.

Figure 2:
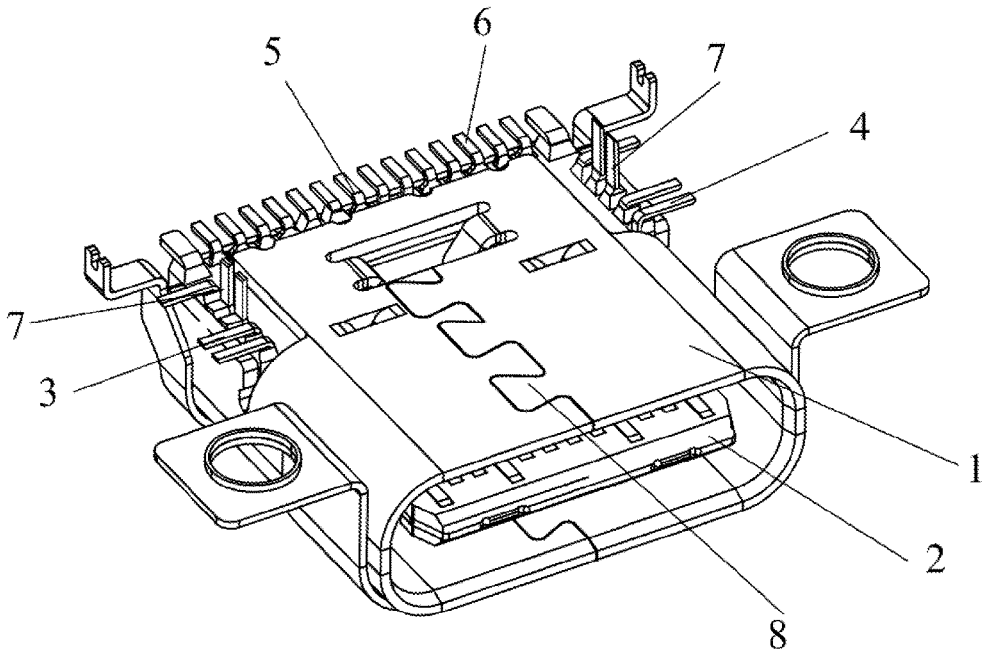
FIG. 2 shows the other schematic structure of the high-low frequency mixed connector in present invention.
Figure 3:
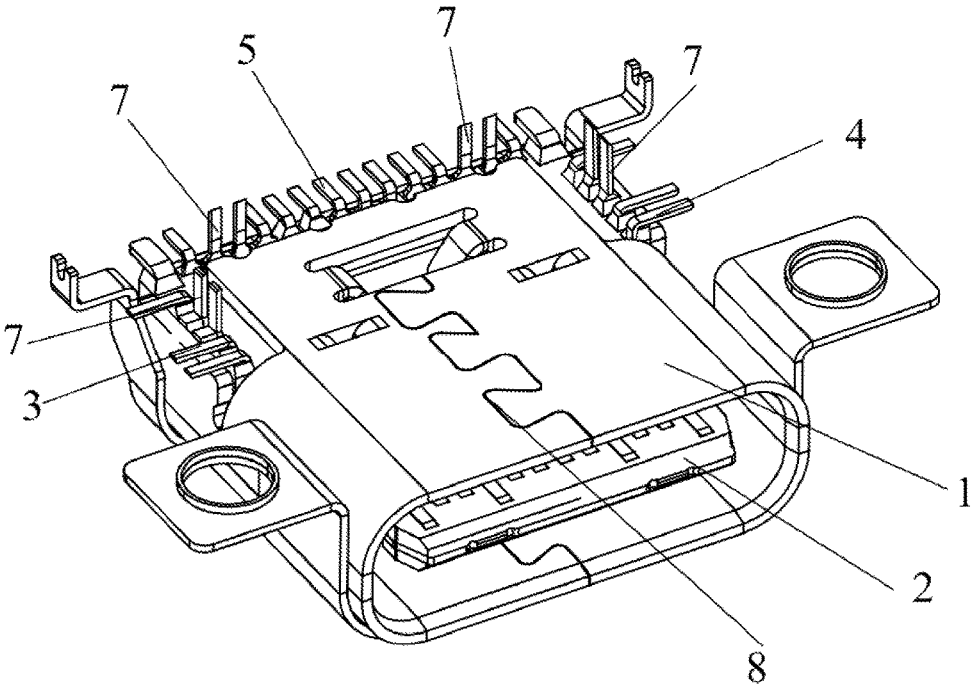
FIG. 3 shows the third schematic structure of the high-low frequency mixed connector in present invention.

Refer to FIG. 1, FIG. 2, FIG. 3, the USB Type-C connector is used as an example to explain the high-low frequency mixed connector in the invention. The USB Type-C connector includes a metal shell 1, an insulator 2 and the first terminal group 3, the second terminal group 4 and the third terminal group 5 that are set on the insulator 2, the metal shell 1 covers the insulator 2. The pins of the first terminal group 3, the pins of the second terminal group 4 and the pins of the third terminal group 5 lead out the metal shell 1 from both sides and back of the metal shell, therefor it is convenience to wiring.

Among the pins of the first terminal group 3, the pins of the second terminal group 4 and the pins of the third terminal group 5, at least one of them contains both the low frequency pins 6 and the high frequency pins 7, and which are set perpendicular to each other.

In the present invention, the first terminal group 3, the second terminal group 4 and the third terminal group 5 are SMT type terminals, DIP type terminals, or DIP and SMT type terminals.

In one of the embodiments in the invention, the first terminal group 3, the second terminal group 4 and the third terminal group 5 are SMT type terminals.

In the other of the embodiments in the invention, the first terminal group 3, the second terminal group 4 and the third terminal group 5 are DIP type terminals.

In another of the embodiments in the invention, the first terminal group 3 and the second terminal group 4 are SMT type terminals, which are lead out both sides of the metal shell from the insulator 2; the third terminal group 5 are DIP type terminals, which are lead out back of the metal shell from the insulator 2.

In another of the embodiments in the invention, the first terminal group 3 and the second terminal group 4 are DIP type terminals, which are lead out both sides of the metal shell from the insulator 2; the third terminal group 5 are DIP type terminals, which are lead out back of the metal shell from the insulator 2.

The pin s are installed on the PCB board in the manner of SMT, DIP or DIP and SMT.

In one of the embodiments in the invention, the pins of the high frequency is welded on PCB board by means of DIP.

In the other of the embodiments in the invention, the pins of the high frequency is welded on PCB board by means of SMT.

In another of the embodiments in the invention, the pins of the high frequency is welded on PCB board by means of DIP and SMT.

Preferably, the riveting face 8 of the metal shell 1 is upwards, the riveting face 8 rivets a shielding shell; the shielding shell is used for sealing the electronic components on the circuit board.

Preferably, the metal shell 1 is provided with an iron tray 9, the iron tray 9 is provided with an insulator, The first terminal group 3 and the second terminal group 4 leads out from both sides or back of the insulator, the third terminal group 5 leads out from back or both sides of the insulator. The first terminal group 3 and the second terminal group 4 is welded on PCB, the third terminal group 5 is welded on PCB.

Preferably, referring to FIG. 4, the kind of high-low frequency mixed connector can be backplane connector, includes an insulator 2' and a number of terminal groups arranged on both sides of the insulator 2'; the terminal groups contains the high frequency pins 7' and the low frequency pins, 6' and which are set perpendicular to each other.

The above content is further elaborated the invention combined with the preferred embodiment of the invention, which can not be identified that the embodiments of the invention are only confined to these instructions. For general technical personnel belonging to the technical field of the invention, without departing from the inventive concept, the architecture can be flexible and be derived a series of products. If it just makes some simple deduction or replacement, it should be regarded as belonging to protection scope that is determined by the submitted claims in the invention.

What is claimed is:

1. A high-low frequency mixed connector, includes an insulator and high frequency pins and low frequency pins set on the insulator, said low frequency pins includes large current pins and small current pins; wherein, said high frequency pins are installed on said insulator by means of shrapnel or hot bar welding, said low frequency pins are installed on said insulator by means of crimping, and said high frequency pins and said low frequency pins are arranged in different directions.

2. A high-low frequency□ mixed□ connector according to claim wherein also includes a metal shell, said mental shell covers said insulator; said insulator is provided with a first terminal group, a second terminal group and a third terminal group; pins of said first terminal group, pins of said second terminal group and pins of said third terminal group lead out said mental shell from both sides and back of said metal shell; among said pins, at least one group contains both said high frequency pins and said low frequency pins, and which are set perpendicular to each other.

3. A high-low frequency□ mixed□ connector according to claim 2, wherein said first terminal group, said second terminal group and said third terminal group are SMT type terminals, DIP type terminals, or DIP and SMT type terminals.

4. A high-low frequency□ mixed□ connector according to claim 2, wherein said first terminal group, said second terminal group and said third terminal group are SMT type terminals.

5. A high-low frequency□ mixed□ connector according to claim 2, wherein said first terminal group, said second terminal group and said third terminal group are DIP type terminals.

6. A high-low frequency□ mixed□ connector according to claim 2, wherein said first terminal group and said second terminal group are SMT type terminals, which are lead out both sides of the metal shell from the insulator, said third terminal group are DIP type terminals, which is lead out back of said metal shell from said insulator.

7. A high-low frequency□ mixed□ connector according to claim 2, wherein said first terminal group and said second terminal group are DIP type terminals, which are lead out both sides of said metal shell from said insulator, said third terminal group are SMT type terminals, which is lead out back of said metal shell from said insulator.

8. A high-low frequency□ mixed□ connector according to claim 2, wherein said pins are installed on the PCB board in the manner of SMT, DIP or DIP and SMT.

9. A high-low frequency□ mixed □ connector according to claim 2, wherein a riveting face of said metal shell is upwards, said riveting face rivets said shielding shell.

10. A high-low frequency□ mixed□ connector according to claim 2, wherein includes a number of terminal groups arranged on both sides of said insulator; said terminal groups contains said high frequency pins and said low frequency pins, and which are set perpendicular to each other.

* * * * *